US010515771B2

(12) United States Patent
Yano

(10) Patent No.: US 10,515,771 B2
(45) Date of Patent: Dec. 24, 2019

(54) SWITCH UNIT

(71) Applicant: Panasonic Intellectual Property Management Co., Ltd., Osaka (JP)

(72) Inventor: Kojiro Yano, Okayama (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/089,338

(22) PCT Filed: Apr. 17, 2017

(86) PCT No.: PCT/JP2017/015410
§ 371 (c)(1),
(2) Date: Sep. 27, 2018

(87) PCT Pub. No.: WO2018/020754
PCT Pub. Date: Feb. 1, 2018

(65) Prior Publication Data

US 2019/0103238 A1 Apr. 4, 2019

(30) Foreign Application Priority Data

Jul. 28, 2016 (JP) ..... 2016-148145

(51) Int. Cl.
*H01H 13/70* (2006.01)
*H01H 13/705* (2006.01)
(Continued)

(52) U.S. Cl.
CPC ..... *H01H 13/705* (2013.01); *H01H 13/79* (2013.01); *H01H 13/703* (2013.01); *H01H 13/807* (2013.01); *H01H 2203/038* (2013.01)

(58) Field of Classification Search
CPC ..... H01H 13/705; H01H 13/10; H01H 13/48; H01H 13/79
(Continued)

(56) References Cited

U.S. PATENT DOCUMENTS 6,274,825 B1 8/2001 Aaltonen et al.
2009/0242374 A1* 10/2009 Ohsumi ..... H01H 13/88 200/5 A

FOREIGN PATENT DOCUMENTS

JP 2006-040808 2/2006
JP 2009-205885 * 9/2009 ..... H01H 13/10
(Continued)

OTHER PUBLICATIONS

International Search Report of PCT application No. PCT/JP2017/015410 dated Jul. 4, 2017.
(Continued)

*Primary Examiner* — Edwin A. Leon
*Assistant Examiner* — Iman Malakooti
(74) *Attorney, Agent, or Firm* — McDermott Will & Emery LLP

(57) ABSTRACT

A switch unit includes a wiring board, a spacer, a movable contact element, a pressing element, and a protective sheet. A first stationary contact element and a second stationary contact element having rectangular shapes are provided on an upper surface of the wiring board. A contact section includes the movable contact element, the first stationary contact element, and the second stationary contact element. The movable contact element is mounted on a portion of the upper surface of the wiring board that is exposed from an inside of an opening of the spacer so that an outer edge of the movable contacts the second stationary contact element. The first stationary contact element continuously extends from a region of the wiring board facing a movable contact portion of the movable contact element to a region of the wiring board outside a region of the wiring board onto which the movable contact element is projected.

14 Claims, 8 Drawing Sheets

(51) Int. Cl.
*H01H 13/79* (2006.01)
*H01H 13/807* (2006.01)
*H01H 13/703* (2006.01)

(58) Field of Classification Search
USPC ..... 200/5 A
See application file for complete search history.

(56) References Cited

FOREIGN PATENT DOCUMENTS

| | | |
|---|---|---|
| JP | 2011-249264 | 12/2011 |
| JP | 2013-125671 | 6/2013 |

OTHER PUBLICATIONS

English Translation of Chinese Search Report dated Aug. 20, 2019 issued in corresponding Chinese Patent Application No. 201780028515.4.

* cited by examiner

SWITCH UNIT

CROSS-REFERENCE TO RELATED APPLICATIONS

This application is a U.S. national stage application of the PCT international application No. PCT/JP2017/015410 filed on Apr. 17, 2017, which claims the benefit of foreign priority of Japanese patent application No. 2016-148145 filed on Jul. 28, 2016, the contents all of which are incorporated herein by reference.

TECHNICAL FIELD

The present disclosure relates to a switch unit used for an operation unit of various types of electronic devices.

BACKGROUND ART

In recent years, a switch unit in which a movable contact element is mounted on a wiring board has been used as an input device for various types of electronic devices.

A conventional switch unit includes a movable contact element mounted on a wiring board, for example, as shown in PTL 1. A first stationary contact element (a second stationary contact 1a) having a circular shape and a second stationary contact element (a first stationary contact 1b) having an annular shape surrounding the first stationary contact element are disposed on the wiring board. The movable contact element is made of an elastic metal having an upwardly convex dome shape having a circular shape when viewed from above. The movable contact element is mounted on an upper surface of the wiring board such that an outer peripheral portion of the movable contact contacts the second stationary contact element. A central portion of the movable contact element faces the first stationary contact element with a predetermined gap in between. The movable contact element deforms upon being pressed in a direction in which the central portion of the movable contact element approaches the wiring board, thereby contacting the first stationary contact element. This configuration allows the conventional switch unit to electrically connect the first stationary contact element with the second stationary contact element via the movable contact element. In other words, the conventional switch unit is turned from an off-state in which the first stationary contact element is electrically insulated from the second stationary contact element to an on-state in which the first stationary contact element is electrically connected with the second stationary contact element.

CITATION LIST

Patent Literature

PTL 1: Japanese Patent Laid-Open Publication No. 2006-40808

SUMMARY

A switch unit according to the present disclosure includes a wiring board including a first stationary contact element and a second stationary contact element, and a movable contact element including a movable contact portion and a pressure receiving portion, the movable contact portion facing the wiring board and the pressure receiving portion located opposite the movable contact portion. The movable contact element deforms by being pressed in a direction in which the pressure receiving portion approaches toward the wiring board from a state in which the movable contact element is spaced from at least the first stationary contact element, and causes the movable contact portion to make contact with the first stationary contact element, so that the movable contact element is switched to a state of being in contact with both the first stationary contact element and the second stationary contact element. This causes the movable contact element to electrically connect the first stationary contact element and the second stationary contact element with each other. The first stationary contact element is formed on the wiring board continuously from a region facing the movable contact portion of the movable contact element to a region that is outward of a projected region in which the movable contact element is projected onto a side of the wiring board.

The switch unit according to the present disclosure allows the positional arrangement of the movable contact element relative to the wiring board to change without changing the arrangement of the first stationary contact element formed on the wiring board.

DETAILED DESCRIPTION OF EMBODIMENT

Exemplary embodiments of the present disclosure will be detailed below with reference to FIGS. 1 to 8.

Problems of the conventional switch unit will be described briefly prior to describing the embodiments of the present disclosure.

In the conventional switch unit described above, the mount position of the movable contact element relative to the wiring board depends on the positional arrangement of the first stationary contact element. Therefore, when the mount position of the movable contact element changes, the positional arrangement of the first stationary contact element is required to change.

The present disclosure resolves such problems of conventional switch units, and provides a switch unit that can change the positional arrangement of the movable contact element relative to the wiring board without changing the positional arrangement of the first stationary contact element provided on the wiring board.

A switch unit according to an exemplary embodiment of the present disclosure will be described with reference to drawings.

Detailed Description of Embodiment

Figure 1:
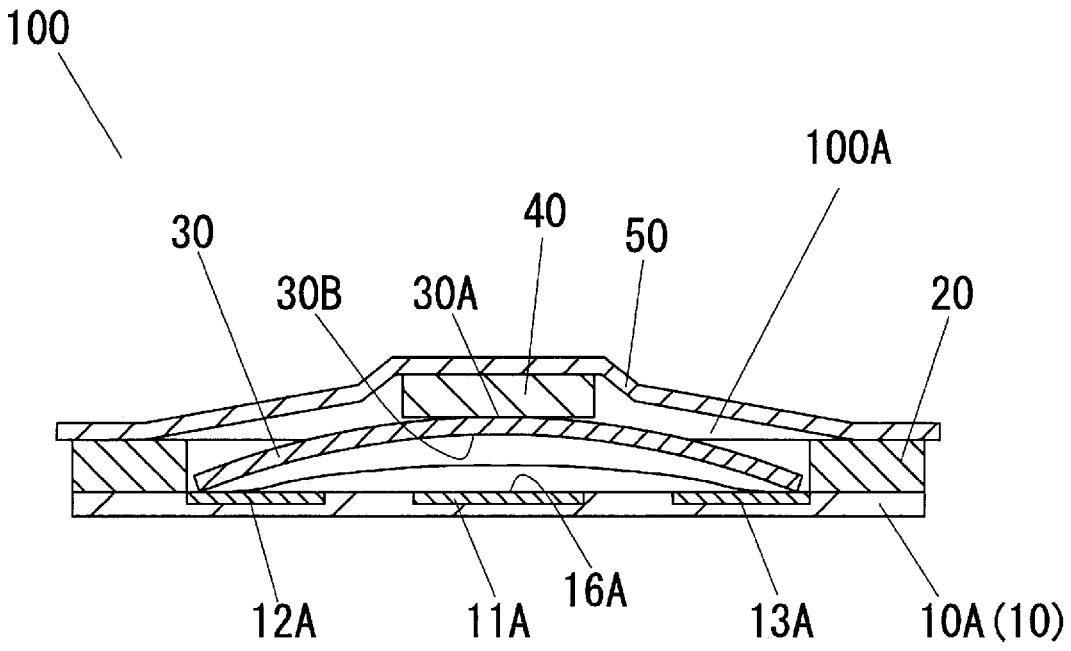
FIG. 1 is a cross-sectional view of a switch unit according to an exemplary embodiment of the present disclosure.
Figure 2:
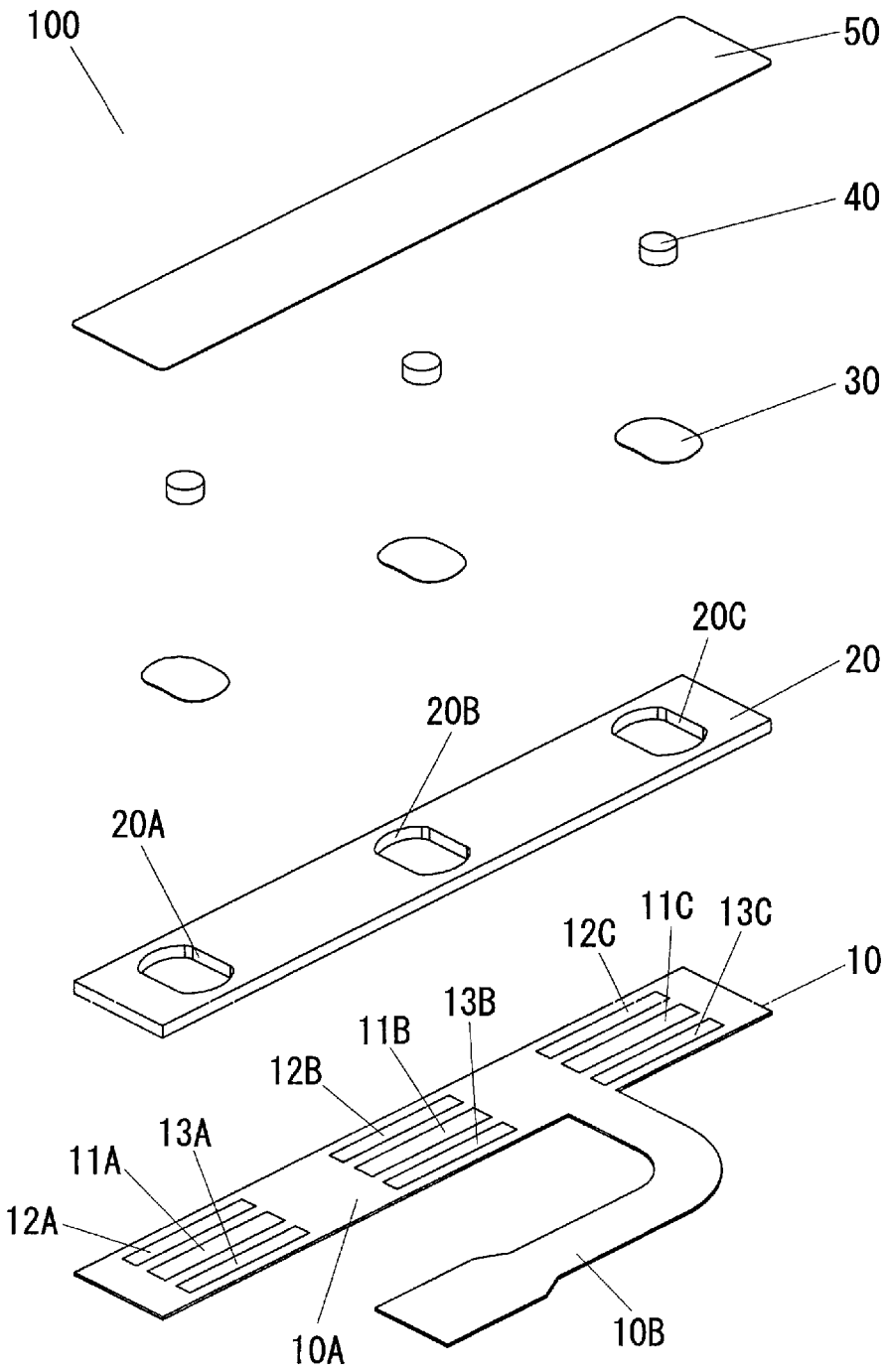
FIG. 2 is an exploded perspective view of the switch unit shown in FIG. 1.
Figure 3:
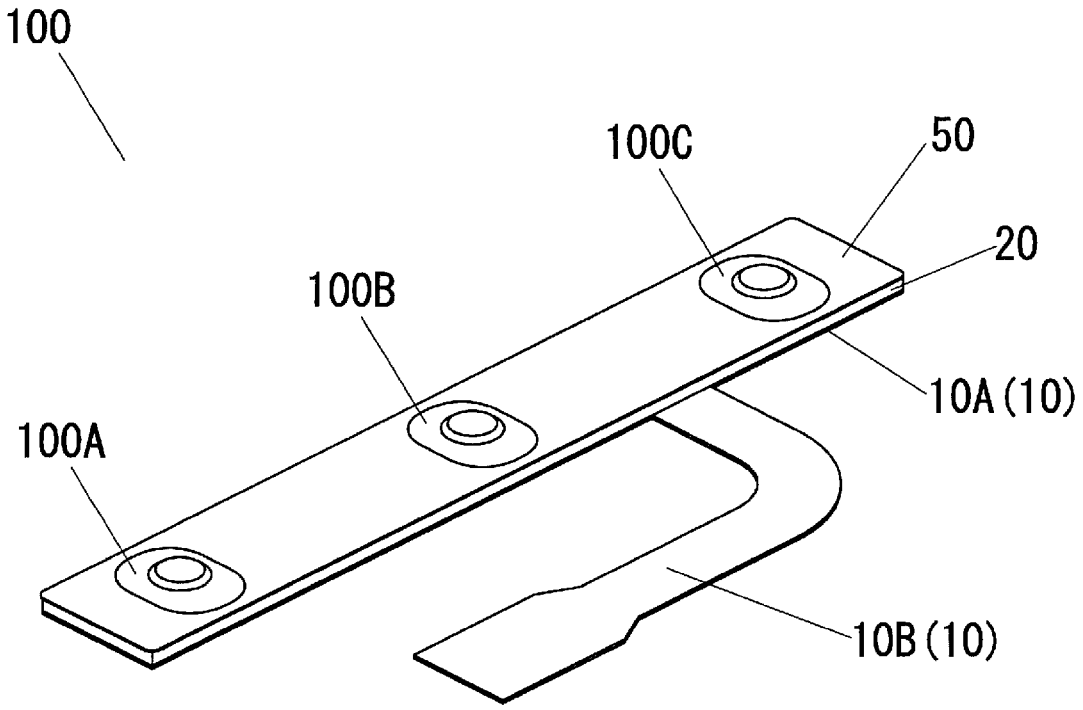
FIG. 3 is a perspective view of the switch unit shown in FIG. 1.
Figure 4:
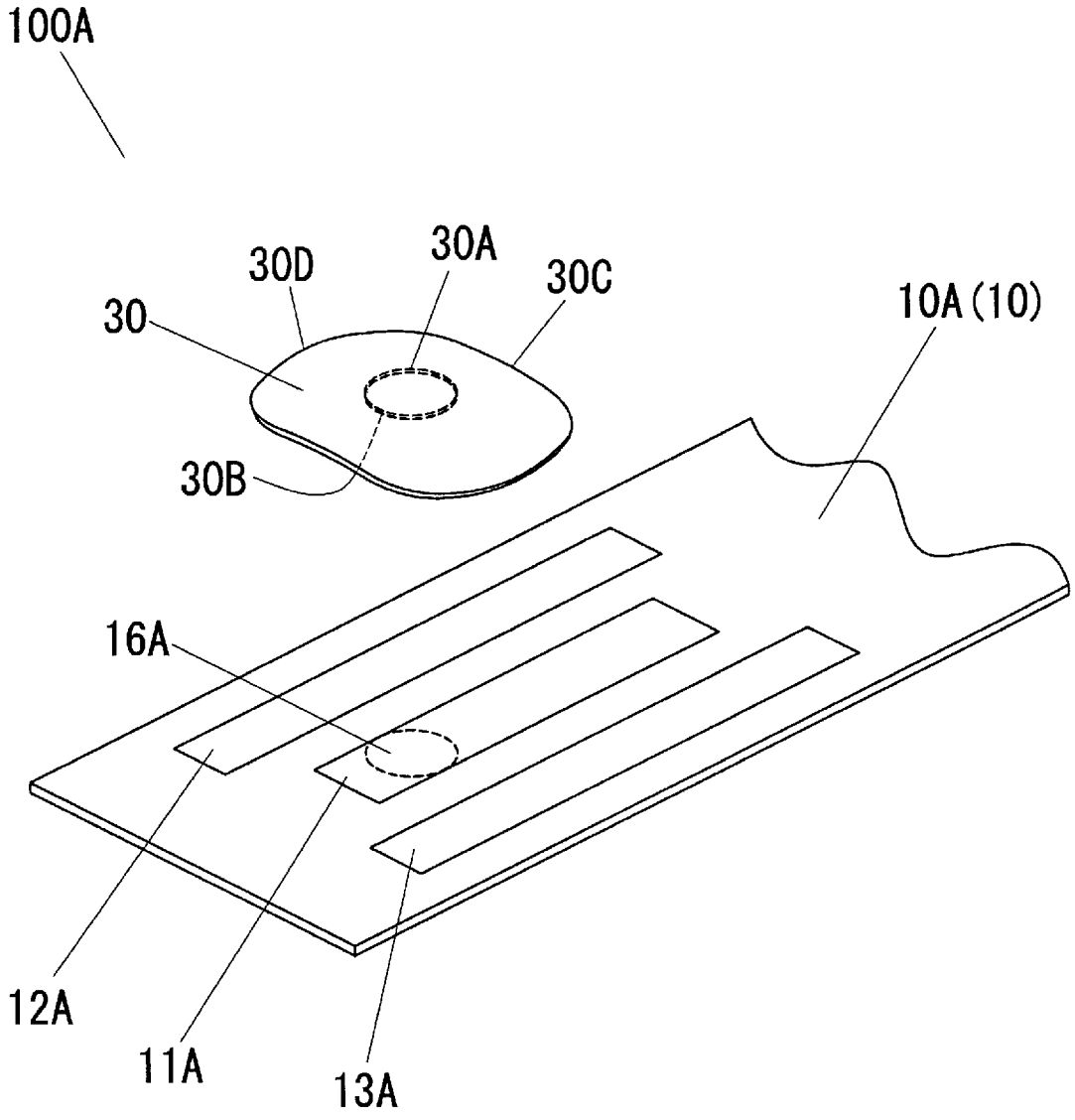
FIG. 4 illustrates a switch portion of the switch unit shown in FIG. 1.
Figure 5:
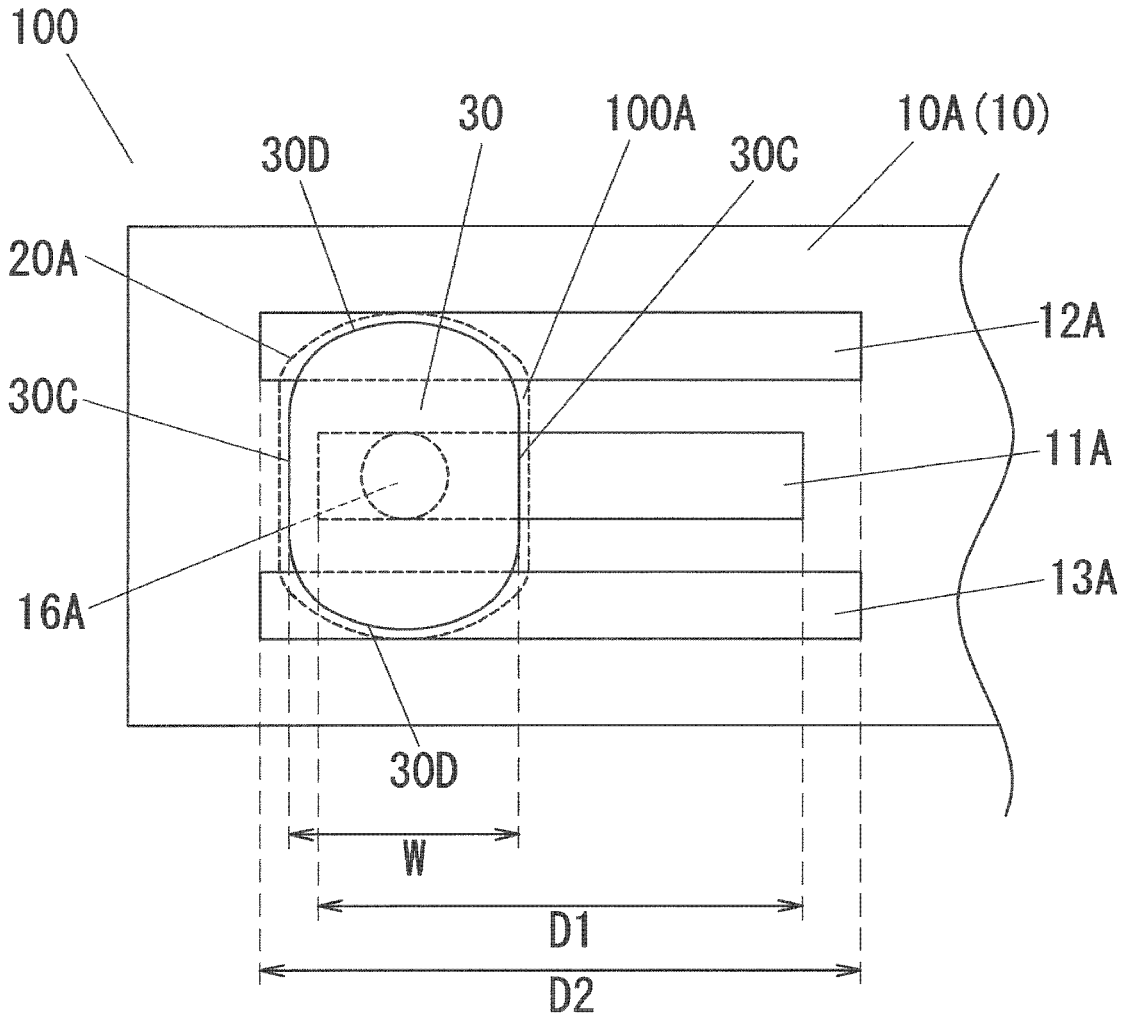
FIG. 5 is a partially enlarged top view of the switch unit shown in FIG. 1.
Figure 6:
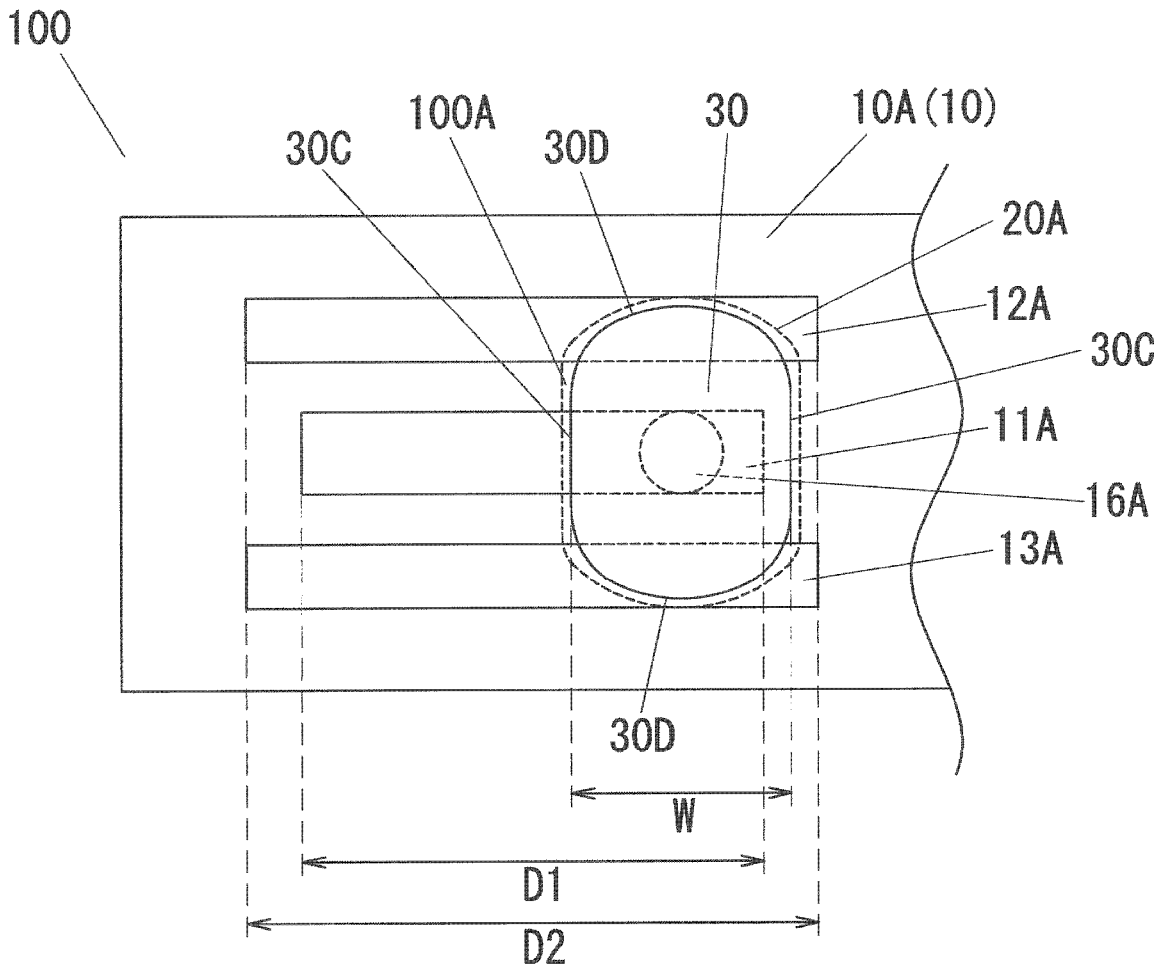
FIG. 6 illustrates the arrangement of a movable contact element changed relative to a wiring board of the switch unit shown in FIG. 1.

FIG. 1 is a cross-sectional view of switch unit 100 according to an exemplary embodiment of the present disclosure. FIG. 2 is an exploded perspective view of switch unit 100. FIG. 3 is a perspective view of switch unit 100. FIG. 4 illustrates contact section 100A of switch unit 100. FIG. 5 is a partially enlarged top view of switch unit 100. FIG. 6 illustrates the positional arrangement of movable contact element 30 changed relative to wiring board 10 of switch unit 100.

As illustrated in FIGS. 1 and 2, switch unit 100 includes wiring board 10, spacer 20, movable contact elements 30, pressing elements 40, and protective sheet 50. First stationary contact element 11A and second stationary contact element 12A having elongated rectangular shapes are provided on an upper surface of wiring board 10. First stationary contact element 11A and second stationary contact element 12A are arranged such that longitudinal directions of the stationary contact elements extend along a longitudinal direction of main part 10A of wiring board 10. As illustrated in FIG. 4, switch unit 100 includes contact section 100A including movable contact element 30, first stationary contact element 11A, and second stationary contact element 12A.

Movable contact element 30 is made of a thin metal plate having a predetermined shape. As illustrated in FIGS. 1 and 4, movable contact element 30 has an upwardly convex shape. Movable contact element 30 is mounted onto a portion of the upper surface of wiring board 10 that is exposed from the inside of opening 20A of spacer 20 such that an outer peripheral portion of movable contact element 30 contacts second stationary contact element 12A. Movable contact element 30 includes pressure receiving portion 30A and movable contact portion 30B. Movable contact portion 30B faces first stationary contact element 11A with a predetermined gap in between. As illustrated in FIG. 4, a surface of movable contact element 30 opposite to movable contact portion 30B constitutes receiving portion 30A. A lower surface of movable contact element 30 that corresponds to pressure receiving portion 30A on the upper surface of movable contact element 30 constitutes movable contact portion 30B. A region of first stationary contact element 11A that faces movable contact portion 30B constitutes first stationary contact portion 16A.

Upon being pressed in a direction in which pressure receiving portion 30A approaches the upper surface of wiring board 10, movable contact element 30 deforms, and thereby, causes the surface (i.e., movable contact portion 30B) of movable contact element 30 that is opposite to pressure receiving portion 30A to contact first stationary contact portion 16A of first stationary contact element 11A. This configuration allows first stationary contact element 11A to be electrically connected with second stationary contact element 12A via movable contact element 30. In other words, switching from an off-state in which first stationary contact element 11A is electrically insulated from second stationary contact element 12A to an on-state in which first stationary contact element 11A is electrically connected with second stationary contact element 12A.

As illustrated in FIG. 1, pressing element 40 is disposed at a position facing pressure receiving portion 30A of movable contact element 30, and is held on a lower surface of protective sheet 50. Protective sheet 50 is disposed so as to cover opening 20A of spacer 20, and is held on an upper surface of spacer 20.

As illustrated in FIG. 5, first stationary contact element 11A and second stationary contact element 12A are disposed on a region of the upper surface of wiring board 10 corresponding to an inside of opening 20A of spacer 20. First stationary contact element 11A and second stationary contact element 12A are disposed also on a region of the upper surface of wiring board 10 that corresponds to an outside of opening 20A of spacer 20. That is, first stationary contact element 11A continuously extends from a region of wiring board 10 that faces movable contact portion 30B of movable contact element 30 to a region of wiring board 10 outside a region onto which movable contact element 30 is projected.

This configuration allows switch unit 100 to change the positional arrangement of movable contact element 30 relative to wiring board 10 from the state shown in FIG. 5 to the state shown in FIG. 6 without changing the positional arrangement of first stationary contact element 11A formed on wiring board 10.

FIG. 5 shows a state in which movable contact element 30 is mounted such that movable contact portion 30B faces a region of first stationary contact element 11A at one end of first stationary contact element 11A in the longitudinal direction of first stationary contact element 11A. In this case, the region of first stationary contact element 11A at the one end of first stationary contact element 11A includes first stationary contact portion 16A configured to contact movable contact portion 30B.

On the other hand, FIG. 6 shows a state in which movable contact element 30 is mounted such that movable contact portion 30B faces a region of first stationary contact element 11A at the other end of first stationary contact element 11A in the longitudinal direction of first stationary contact element 11A. In this case, the region of first stationary contact element 11A at the other end of first stationary contact element 11A includes first stationary contact portion 16A configured to contact movable contact portion 30B.

Thus, switch unit 100 allows the position of first stationary contact portion 16A of first stationary contact element 11A to change dependently on the positional arrangement of movable contact element 30. In other words, switch unit 100 can change the position of first stationary contact portion 16A without changing the positional arrangement of first stationary contact element 11A. Accordingly, as long as movable contact portion 30B of movable contact element 30 is within the area in which movable contact portion 30B faces first stationary contact element 11A, switch unit 100 can arbitrarily change the positional arrangement of movable contact element 30 without changing the positional arrangement of first stationary contact element 11A. Therefore, only one type of wiring board 10 can provide plural types of switch units 100 having different positional arrangements of movable contact element 30.

A configuration and an operation of switch unit 100 will be detailed below.

As illustrated in FIGS. 1 to 3, switch unit 100 includes wiring board 10, spacer 20, three movable contact elements 30, three pressing elements 40, and protective sheet 50. Wiring board 10 has first stationary contact elements 11A to 11C, second stationary contact elements 12A to 12C, and third stationary contact elements 13A to 13C provided thereon. As illustrated in FIG. 3, switch unit 100 includes contact sections 100A to 100C. Contact sections 100A to 100C are arranged in a straight line at equal intervals.

As illustrated in FIG. 4, contact section 100A includes movable contact element 30, first stationary contact element 11A, and second stationary contact element 12A. contact section 100B includes movable contact element 30, first stationary contact element 11B, and second stationary contact element 12B. Contact section 100C includes movable contact element 30, first stationary contact element 11C, and second stationary contact element 12C. Contact sections 100B and 100C have the same structure as contact section 100A, and therefore, details of contact sections 100B and 100C are not shown in the drawings.

Wiring board 10 includes predetermined conductive patterns provided thereon, and includes, for example, a polyimide flexible printed circuit board (FPC) having flexibility. Wiring board 10 includes main part 10A and lead part 10B extending outward from main part 10A. Main part 10A has a rectangular shape with a predetermined width. Lead part 10B has a predetermined width. First stationary contact elements 11A to 11C, second stationary contact elements 12A to 12C, and third stationary contact elements 13A to 13C are provided on an upper surface of main part 10A of wiring board 10. First stationary contact elements 11A to 11C have rectangular shapes extending in a longitudinal direction of main part 10A. Second stationary contact elements 12A to 12C have rectangular shapes extending in a longitudinal direction of main part 10A. Third stationary contact elements 13A to 13C have rectangular shapes extending in a longitudinal direction of main part 10A, All of second stationary contact element 12A to 12C and third stationary contact element 13A to 13C have the same shape viewed from above. First stationary contact element 11A and third stationary contact element 13A are disposed parallel to each other and adjacent to each other. Second stationary contact element 12B and third stationary contact element 13B are disposed parallel to each other and adjacent to each other. Second stationary contact element 12C and third stationary contact element 13C are also disposed parallel to each other and adjacent to each other. All of second stationary contact elements 12A to 12C and third stationary contact elements 13A to 13C are electrically in contact with one another.

On the other hand, first stationary contact elements 11A to 11C has rectangular shapes with a slightly shorter length than second stationary contact elements 12A to 12C and third stationary contact elements 13A to 13C. First stationary contact element 11A is disposed between second stationary contact element 12A and third stationary contact element 13A. First stationary contact element 11B is disposed between second stationary contact element 12B and third stationary contact element 13B. First stationary contact element 11C is also disposed between second stationary contact element 12C and third stationary contact element 13C. First stationary contact elements 11A to 11C are electrically independent from one another, and electrically connected to respective connection terminals (not shown) provided at a tip end portion of lead part 10B via respective lead wiring lines (not shown) disposed on wiring board 10. The connector terminals are connected to a connector of an electronic device which is not shown in the drawings so that switch unit 100 can be used as an input operation unit of the electronic device.

Spacer 20 has a rectangular-shape and is made of an electrically insulative resin having a predetermined thickness. The outer shape of spacer 20 is substantially identical to the shape of main part 10A of wiring board 10 viewed from above. Spacer 20 is firmly adhered to the upper surface of wiring board 10 with an adhesive agent such as a thermosetting adhesive agent and an ultraviolet (UV) curable adhesive agent that is formed on the lower surface of spacer 20. Spacer 20 has openings 20A to 20C provided therein. Openings 20A to 20C are arranged at equal intervals in a straight line. Openings 20A to 20C are formed at positions corresponding to first stationary contact elements 11A to 11C, respectively. That is, first stationary contact elements 11A to 11C, second stationary contact elements 12A to 12C, and third stationary contact elements 13A to 13C are exposed from the insides of openings 20A to 20C of spacer 20, respectively.

The shape of each of openings 20A to 20C is slightly larger than movable contact element 30 viewed from above, which will be discussed later. In accordance with the present embodiment, each of openings 20A to 20C has a track shape (i.e., an oval shape) viewed from above. Each of movable contact elements 30 are accommodated inside respective one of openings 20A to 20C, so that each of movable contact elements 30 is retained and restricted in lateral directions. In accordance with the present embodiment, spacer 20 has three openings 20A to 20C therein and stacked on wiring board 10. Instead, three spacers each having only one opening 20A may be prepared and disposed consecutively on the upper surface of wiring board 10.

Movable contact element 30 is made of a thin metal plate with a predetermined shape. Movable contact element 30 has an upwardly convex dome shape. The shape of movable contact element 30 viewed from above is a track shape (oval shape) such that opposite side ends of a circular shape is cut away along parallel straight lines. As illustrated in FIG. 4, when viewed from above, movable contact element 30 includes two linear portions 30C cut away along parallel straight lines and two curved portions 30D which are not cut away. The reference numerals of linear portions 30C and curved portions 30D are shown in FIGS. 4, 5, and 6, and not shown in the other figures.

In accordance with the present embodiment, three movable contact elements 30 are accommodated in openings 20A to 20C of spacer 20, respectively, and are mounted on the upper surface of the wiring board 10. Each of the outer edges (the lower ends of curved portions 30D) of movable contact elements 30 contacts respective one of the upper surfaces of second stationary contact elements 12A to 12C and third stationary contact elements 13A to 13C of wiring board 10.

As illustrated in FIG. 4, movable contact element 30 includes pressure receiving portion 30A and movable contact portion 30B. Pressure receiving portion 30A is located at a central portion of movable contact element 30. That is, pressure receiving portion 30A includes a region of movable contact element 30 that protrudes most upward. In other words, pressure receiving portion 30A includes the region farthest away from the upper surface of wiring board 10 in the normal direction. As illustrated in FIG. 4, a portion of the surface of movable contact element 30 that are opposite to pressure receiving portion 30A and that corresponds to pressure receiving portion 30A constitutes movable contact portion 30B. Each of the surfaces (i.e., movable contact portions 30B) of movable contact elements 30 opposite to pressure receiving portions 30A faces respective one of the upper surfaces of first stationary contact elements 11A to 11C with a predetermined gap in between. The reference numerals of pressure receiving portion 30A and movable contact portion 30B are shown only in FIGS. 1 and 4, and are not shown in the other figures.

The positional relationship among first stationary contact elements 11A to 11C, second stationary contact elements 12A to 12C, third stationary contact elements 13A to 13C, and movable contact elements 30 will be detailed below mainly with reference to FIGS. 4 and 5. First stationary contact elements 11A to 11C have the same shape. Second stationary contact element 12A to 12C have the same shape. Third stationary contact element 13A to 13C have the same shape. For simplicity, only first stationary contact element 11A, second stationary contact element 12A, and third stationary contact element 13A will be described below.

FIG. 5 is a partially enlarged top view of switch unit 100 in which pressing element 40 and protective sheet 50 are not shown for the sake of brevity in illustration. In FIG. 5, only opening 20A of spacer 20 is indicated by a dashed line.

As illustrated in FIGS. 4 and 5, first stationary contact element 11A has a rectangular shape with a predetermined width. The longitudinal dimension (i.e., width D1) of first stationary contact element 11A is greater than that of the shape of movable contact element 30 viewed from above. The longitudinal dimension (i.e., width D1) of first stationary contact element 11A may be preferably greater than the dimension (i.e., width W) of a line that connected with two linear portions 30C of movable contact element 30. Width D1 may be preferably equal to or larger than twice the width W. First stationary contact element 11A extends continuously from a region of wiring board 10 that faces movable contact portion 30B of movable contact element 30 to a region of wiring board 10 outside a region of wiring board 10 onto which movable contact element 30 is projected. In other words, when viewed from above, first stationary contact element 11A extends from the region facing movable contact portion 30B of movable contact element 30 outwardly beyond linear portions 30C of movable contact element 30. In addition, the longitudinal dimension (width D2) of each of second stationary contact element 12A and third stationary contact element 13A may be preferably equal to or larger than twice the width W.

The shape of movable contact element 30 viewed from above is a track shape (oval shape) such that opposite side ends of a circular shape is cut away along parallel straight lines, as described above. Therefore, the lower ends of the linear portions 30C are located higher than the lower ends of curved portions 30D. Therefore, as shown in, e.g. FIG. 1, first stationary contact element 11A extends outwardly beyond linear portions 30C of movable contact element 30 without contacting movable contact element 30.

As illustrated in FIG. 4, the region of first stationary contact element 11A facing movable contact portion 30B constitutes first stationary contact portion 16A. Although not shown or reference numerals shown in the drawings, in first stationary contact elements 11B and 11C as well, the respective regions first stationary contact elements 11B and 11C facing movable contact portions 30B of movable contact elements 30 constitute first stationary contact portions 16B and 16C, respectively.

As described above, both second stationary contact element 12A and third stationary contact element 13A have rectangular shapes with predetermined widths. The longitudinal dimensions of second stationary contact element 12A and third stationary contact element 13A are slightly greater than the longitudinal dimension of first stationary contact element 11A. Both of second stationary contact element 12A and third stationary contact element 13A contact respective lower ends of curved portions 30D of movable contact element 30.

Spacer 20 overlaps portions of first stationary contact element 11A, second stationary contact element 12A, and third stationary contact element 13A that are disposed outside opening 20A of spacer 20. This configuration prevents first stationary contact element 11A, second stationary contact element 12A, and third stationary contact element 13A from being exposed unnecessarily, and thereby, protects the contact elements from corrosion, such as oxidation.

Pressing element 40 is made of an electrically insulating resin. As illustrated in FIG. 2, pressing element 40 has a circular columnar shape. In accordance with the present embodiment, three pressing elements 40 are firmly bonded to the lower surface of protective sheet 50. Protective sheet 50 is welded to pressing elements 40 by laser application or ultrasonic processing. Pressing elements 40 face respective pressure receiving portions 30A of movable contact elements 30. That is, each of pressing elements 40 is placed on a central portion of the upper surface of movable contact element 30. If protective sheet 50 is fixed to pressing element 40 by welding, protective sheet 50 and pressing element 40 may be preferably made of the same material. Pressing element 40 may be firmly bonded to protective sheet 50 with, e.g. a thermosetting adhesive agent or an ultraviolet (UV) curable adhesive agent. Pressing element 40 may be heated and press-inserted into protective sheet 50 from the lower surface of protective sheet 50 to be firmly bonded to protective sheet 50.

Protective sheet 50 is made of an electrically insulating film and is disposed over spacer 20 disposed so as to cover openings 20A to 20C. The outer peripheral portion of protective sheet 50 is firmly bonded to the upper surface of spacer 20. That is, a hermetically sealed state is obtained by closing openings 20A to 20C of spacer 20 with protective sheet 50. Protective sheet 50 may be firmly bonded so as to surround the respective outer edges of openings 20A to 20C of spacer 20. In accordance with the present embodiment, protective sheet 50 is welded and fixed to the upper surface of spacer 20 by, for example, laser application or ultrasonic processing. When protective sheet 50 and spacer 20 are fixed by welding, protective sheet 50 and spacer 20 be made of the same material. Protective sheet 50 may be retained on the upper surface of spacer 20 with a thermosetting adhesive agent, an ultraviolet curable (UV curable) adhesive agent, or an adhesive material.

In accordance with the present embodiment, one protective sheet 50 covers openings 20A to 20C, three protective sheets may be smaller than protective sheet 50 and cover respective openings 20A to 20C.

Switch unit 100 is configured as described above. As described above, switch unit 100 includes three contact sections 100A to 100C arranged along a straight line. A technical idea of the disclosure of the present application encompasses a switch unit including only contact section 100A.

Next, an operation of switch unit 100 will be described briefly taking, e.g. a switching operation of contact section 100A. Contact sections 100B and 100C operate in the same manner. When the operator depresses pressing element 40 downwardly via protective sheet 50, the pressing force is transmitted to pressure receiving portion 30A of movable contact element 30 via pressing element 40, causing movable contact element 30 to flip downwardly with a click feel. This operation causes movable contact portion 30B of movable contact element 30 to contact and first stationary contact portion 16A of first stationary contact element 11A. As a result, first stationary contact element 11A is electrically connected with second stationary contact element 12A via movable contact element 30, thus turning on contact section 100A as an on-state. Then, when the operator releases the pressing force, movable contact element 30 is brought back to has the original, upwardly convex dome shape by its own restoring force. Therefore, contact section 100A returns to an off-state, in which first stationary contact element 11A is electrically insulated from second stationary contact element 12A.

First stationary contact element 11A is electrically connected with second stationary contact element 12A via movable contact element 30. Third stationary contact element 13A may not necessarily be connected with second stationary contact element 12A. Third stationary contact element 13A may not be provided. Nevertheless, In the case that third stationary contact element 13A is provided, curved portion 30D of movable contact element 30 can contact either one of second stationary contact element 12A and third stationary contact element 13A, as in switch unit 100 of the present embodiment, movable contact element 30 can be mounted stably on wiring board 10. This configuration provides a stable operation feel.

In switch unit 100 of the present exemplary embodiment, first stationary contact element 11A extends continuously from a region of wiring board 10 that faces movable contact portion 30B of movable contact element 30 to a region of wiring board 10 that is outside of a region onto which movable contact element 30 is projected. This configuration allows switch unit 100 to change the positional arrangement of movable contact element 30 relative to wiring board 10 from the state shown in FIG. 5 to the state shown in FIG. 6, without changing the positional arrangement of first stationary contact element 11A formed on wiring board 10. This will be detailed below.

FIG. 6 is a partially enlarged top view of switch unit 100 in which the positional arrangement of movable contact element 30 is changed. In FIG. 6, pressing element 40 and protective sheet 50 are not shown, as in FIG. 5. FIG. 6 shows only opening 20A of spacer 20 by dashed lines. In spacer 20 shown in FIG. 6, the position of opening 20A is changed as appropriate according to the change in positional arrangement of movable contact element 30 as described above.

FIG. 5 shows a state in which movable contact element 30 of movable contact element 30 is mounted at the position at which movable contact portion 30B faces a region of first stationary contact element 11A at one end along a longitudinal direction of first stationary contact element 11A. In this case, the region of first stationary contact element 11A at the one end constitutes first stationary contact portion 16A which is configured to contact movable contact portion 30B. Each of the lower ends of curved portions 30D of movable contact element 30 contacts respective one of a region of second stationary contact element 12A at the one end and a region of third stationary contact element 13A at the one end.

On the other hand, FIG. 6 shows a state in which movable contact element 30 of movable contact element 30 is mounted at the position at which movable contact portion 30B faces a region of first stationary contact element 11A at the other end along the longitudinal direction of first stationary contact element 11A. In this case, the region of first stationary contact element 11A at the other end includes first stationary contact portion 16A which is configured to contact movable contact portion 30B. Each of the lower ends of curved portions 30D of movable contact element 30 contacts respective one of a region of second stationary contact element 12A at the other end and a region of third stationary contact element 13A at the other end. Thus, even when the positional arrangement of movable contact element 30 is shifted from one end of first stationary contact element 11A to the other end, contact section 100A is capable of switching operation. In other words, switch unit 100 is capable of switching operation either in the state shown in FIG. 5 or in the state shown in FIG. 6.

Thus, switch unit 100 allows the position of first stationary contact portion 16A to change depending on the positional arrangement of movable contact element 30. In other words, as long as movable contact portion 30B of movable contact element 30 is within the area in which movable contact portion 30B faces first stationary contact element 11A, switch unit 100 can arbitrarily change the positional arrangement of movable contact element 30 without changing the positional arrangement of first stationary contact element 11A. Therefore, since switch unit 100 does not necessarily change the positional arrangement of the first stationary contact element depending on the mount position of the movable contact element, only one type of wiring board 10 is required to construct plural types of switch units 100 having different positional arrangements of movable contact element 30.

Electronic devices having the switch unit incorporated therein generally includes plural pushbuttons, and the positional arrangement of the pushbuttons are determined according to various design conditions, such as the design of the electronic device and the layout of electronic components. This means that different switch units with different positional arrangements of contact sections need to be manufactured according to the positional arrangement of pushbuttons required by various electronic devices.

The switch unit according to the present exemplary embodiment is adapted to change the positional arrangement of movable contact elements 30 in contact sections 100A to 100C. That is, switch unit 100 is adapted to appropriately set the positional arrangement of contact sections 100A to 100C and the distances therebetween (for example, the distance between contact section 100A and contact section 100C). In other words, unlike conventional switch units, switch unit 100 can change the positional arrangements of the contact sections and the distances therebetween, without preparing wiring boards in which the first stationary contact elements and the second stationary contact elements are arranged according to the positional arrangement of the pushbuttons required by various electronic devices.

The switch unit according to the technical idea of the present disclosure does not necessarily include the plural contact sections 100A to 100C, and may include, e.g. only contact section 100A.

Figure 7:
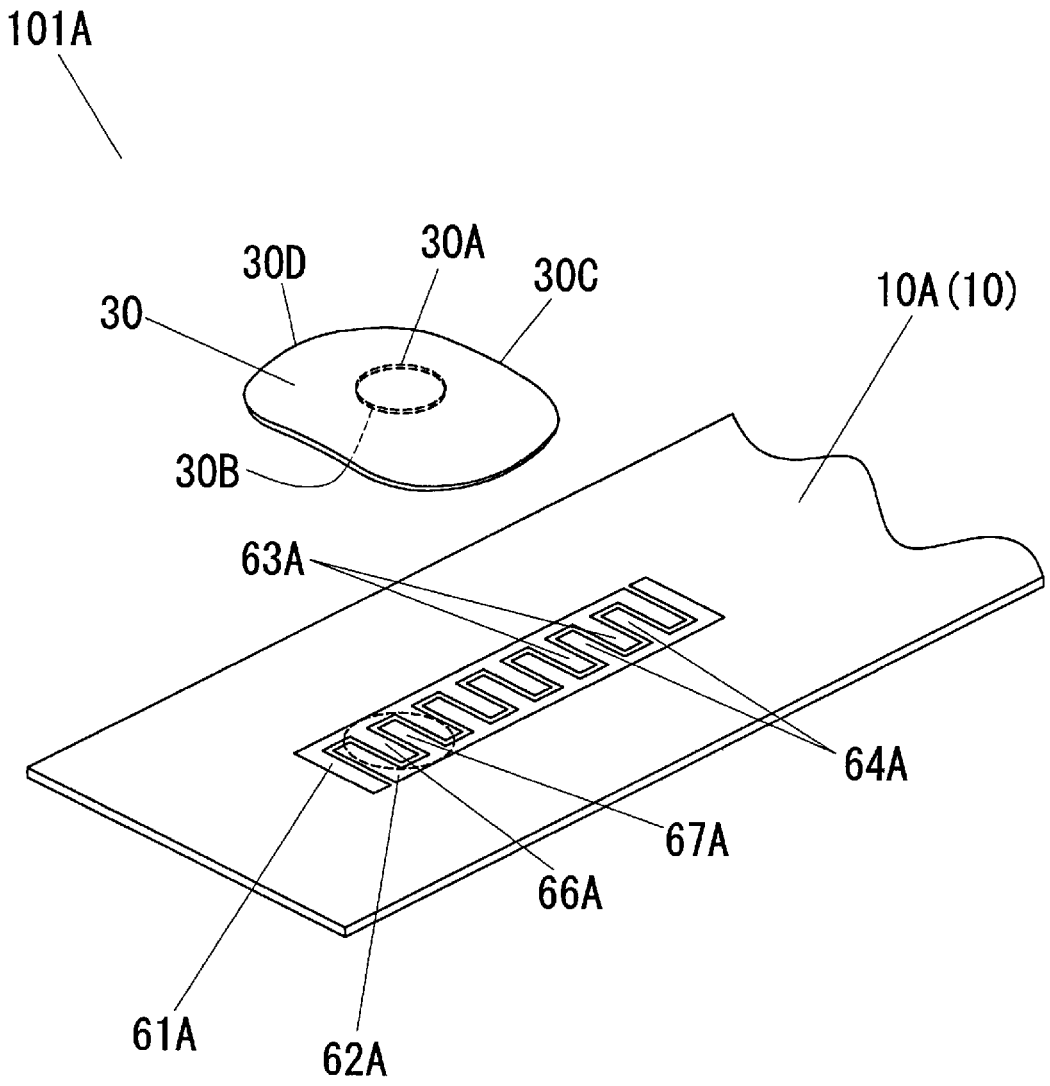
FIG. 7 illustrates a switch unit of Modified Example 1 according to the embodiment of the present disclosure.
Figure 8:
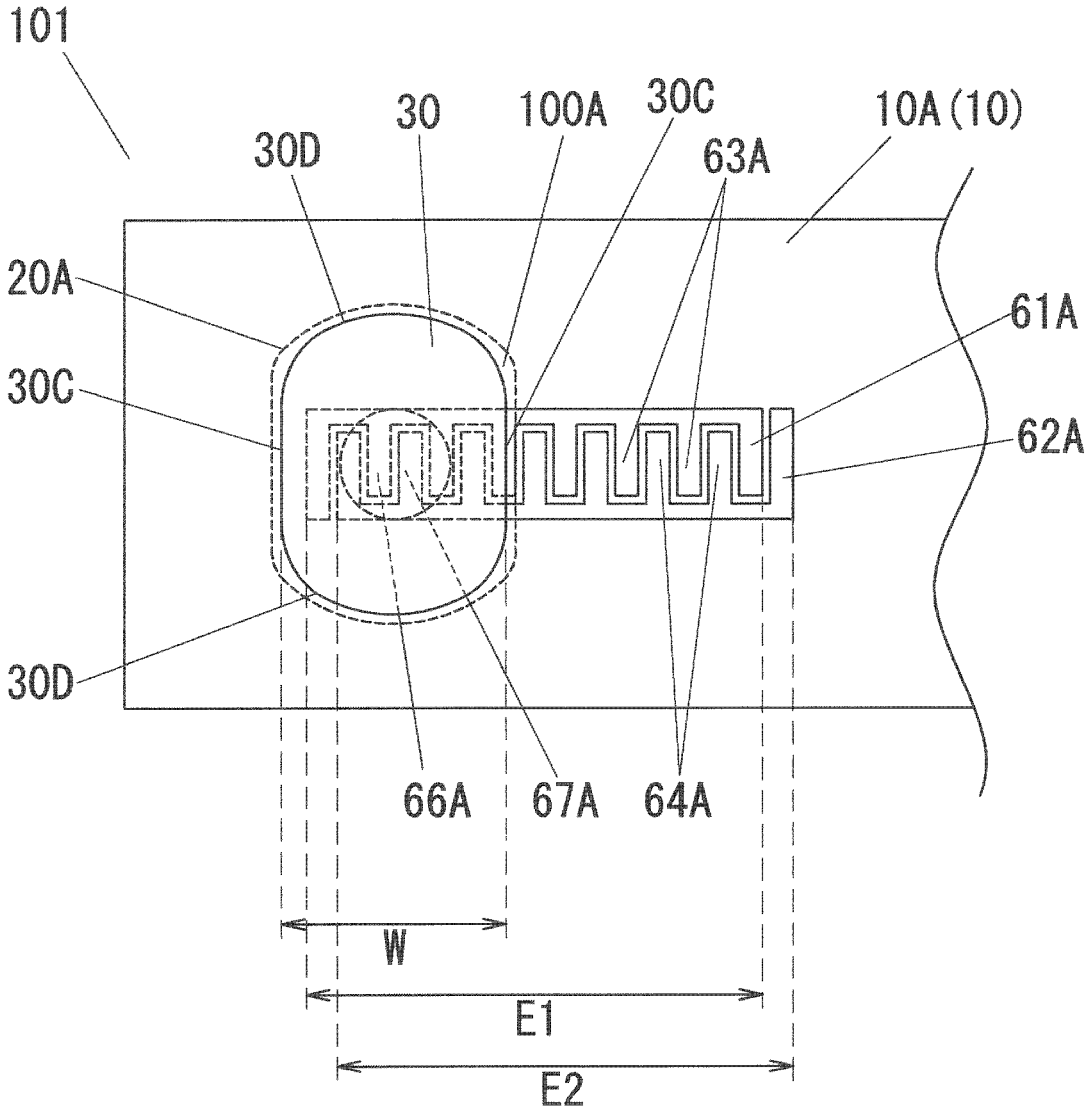
FIG. 8 is a partially enlarged top view of the switch unit of Modified Example 1 according to the embodiment of the present disclosure.

In accordance with the above-described exemplary embodiment, wiring board 10 on which second stationary contact elements 12A to 12C are disposed at positions contacting curved portions 30D of respective movable contact elements 30. Wiring board 10 may be modified to those as shown in FIGS. 7 and 8. Modified examples of the switch unit according to the present disclosure will be described below.

Modified Examples

FIG. 7 illustrates the configuration of contact section 101A according to modified example 1 of the exemplary embodiment of the present disclosure. FIG. 8 is a partially enlarged top view of switch unit 101 according to modified example 1 of the exemplary embodiment of the present disclosure. In FIG. 8, pressing element 40 and protective sheet 50 are not shown for the sake of brevity in illustration. FIG. 8 shows only opening 20A of spacer 20 with dashed lines. The parts that have the same configuration as those described in the foregoing exemplary embodiment are denoted by the same reference numerals and the description thereof is omitted. The description will focus on differences from the foregoing exemplary embodiment.

Switch unit 101 according to modified example 1, as well as switch unit 100, includes plural contact sections (contact sections 101A to 101C), FIGS. 7 and 8 depict only the portion related to contact section 101A. The configurations of contact sections 101B and 101C are identical to the configuration of contact section 101A, and therefore, the descriptions thereof are omitted.

As illustrated in FIG. 7, contact section 101A includes movable contact element 30, first stationary contact element 61A, and second stationary contact element 62A. In contact section 101A, both of first stationary contact element 61A and second stationary contact element 62A are disposed at positions facing movable contact portion 30B of movable contact element 30.

As illustrated in FIGS. 7 and 8, each of first stationary contact element 61A and second stationary contact element 62A is a stationary contact element extending along the longitudinal direction of main part 10A of wiring board 10. First stationary contact element 61A and second stationary contact element 62A are disposed on the upper surface of wiring board 10 and are electrically independent from each other. First stationary contact element 61A includes plural electrodes 63A having rectangular shapes. First stationary contact element 61A has a comb shape in which one ends of plural electrodes 63A are electrically connected. Similarly, second stationary contact element 62A includes plural electrodes 64A having rectangular shapes. Second stationary contact element 62A has a comb shape in which one ends of plural electrodes 64A are electrically connected. In other words, first stationary contact element 61A and second stationary contact element 62A are comb electrodes. Electrodes 63A and electrodes 64A are disposed alternately with predetermined gaps among them.

A region of first stationary contact element 61A facing movable contact portion 30B constitutes first stationary contact portion 66A. A region of second stationary contact element 62A facing movable contact portion 30B constitutes second stationary contact portion 67A.

Movable contact element 30 deforms upon being pressed in a direction in which pressure receiving portion 30A approaches the upper surface of wiring board 10, thereby causing the surface thereof opposite to pressure receiving portion 30A (i.e., movable contact portion 30B) to contact first stationary contact portion 66A and second stationary contact portion 67A. This configuration allows first stationary contact element 61A to be electrically connected with second stationary contact element 62A via movable contact element 30. In other words, switching takes place from an off-state in which first stationary contact element 61A is electrically insulated from second stationary contact element 62A to an on-state in which first stationary contact element 61A is electrically connected with second stationary contact element 62A.

As illustrated in FIG. 8, the longitudinal dimension (i.e., width E1) of first stationary contact element 61A is larger than that of movable contact element 30 viewed from above. The longitudinal dimension (i.e., width E2) of second stationary contact element 62A is greater than that of movable contact element 30 viewing from above. That is, each of first stationary contact element 61A and second stationary contact element 62A extend continuously from a region of wiring board 10 that faces movable contact portion 30B of movable contact element 30 to a region of wiring board 10 outside a region onto which movable contact element 30 is projected. In other words, when viewed from above, each of first stationary contact element 61A and second stationary contact element 62A extends from a region that faces movable contact portion 30B of movable contact element 30 outwardly beyond linear portions 30C of movable contact element 30.

As illustrated in FIG. 8, the longitudinal dimension (i.e., width E1) of first stationary contact element 61A may preferably be greater than the dimension (i.e., width W) of a line that connects two linear portions 30C of movable contact element 30. Width E1 is preferably equal to or larger than twice the width W. The longitudinal dimension (i.e., width E2) of second stationary contact element 62A is larger than that of movable contact element 30 viewed from above. The longitudinal dimension (i.e., width E2) of second stationary contact element 62A may preferably larger than the dimension (i.e., width W) of a line that connects two linear portions 30C of movable contact element 30. Width E2 may be preferably equal to or larger than twice the width W.

Accordingly, as long as movable contact portion 30B of movable contact element 30 is within the area in which movable contact portion 30B faces both of first stationary contact element 61A and second stationary contact element 62A, switch unit 101 can arbitrarily change the positional arrangement of movable contact element 30.

INDUSTRIAL APPLICABILITY

A switch unit according to the present disclosure is useful for electronic devices incorporating the switch unit according to the present disclosure since the switch unit according to the present disclosure can change the positional arrangement of the movable contact element relative to the wiring board without changing the positional arrangement of the first stationary contact element formed on the wiring board.

REFERENCE MARKS IN THE DRAWINGS

10 wiring board
10A main part
10B lead part
11A, 11B, 11C first stationary contact element
12A, 12B, 12C second stationary contact element
13A, 13B, 13C third stationary contact element
16A, 16B, 16C first stationary contact portion
20 spacer
20A, 20B, 20C opening
30 movable contact element
30A pressure receiving portion
30B movable contact portion
30C linear portion
30D curved portion
40 pressing element
50 protective sheet
61A first stationary contact element
62A second stationary contact element
63A, 64A electrode
66A first stationary contact portion
67A second stationary contact portion
100, 101 switch unit
100A, 100B, 100C, 101A, 101B, 101C contact section

The invention claimed is:

1. A switch unit comprising:

a wiring board including a first stationary contact element and a second stationary contact element; and a movable contact element including a movable contact portion and a pressure receiving portion, the movable contact portion facing the wiring board, the pressure receiving portion being located opposite to the movable contact portion, the movable contact element deforming upon being pressed in a direction in which the pressure receiving portion approaches the wiring board from a state in which at least the movable contact portion is spaced from the first stationary contact element, thereby causing the movable contact portion to contact the first stationary contact element so as to allow the movable contact element to be switched to a state in which the movable contact portion to contact both the first stationary contact element and the second stationary contact element so as to electrically connect the first stationary contact element with the second stationary contact element, wherein the first stationary contact element continuously extends from a region of the wiring board facing the movable contact portion to a region of the wiring board outside a region of the wiring board onto which the movable contact element is projected, wherein each of the first stationary contact element and the second stationary contact element extend linearly in a predetermined direction, and wherein a length of the second stationary contact element in the predetermined direction is larger than a width of the movable contact portion in the predetermined direction.

2. The switch unit of claim 1, wherein the movable contact element has a dome shape which if convex, and wherein the pressure receiving portion of the movable contact element includes a portion of a region of the movable contact element farthest from the wiring board.

3. The switch unit of claim 1, further comprising a spacer having an opening provided therein, wherein the spacer overlaps the wiring board such that at least a portion of the first stationary contact element and at least a portion of the second stationary contact element are positioned in an inner region of the opening, and wherein the movable contact element is disposed in the inner region of the opening.

4. The switch unit of claim 3, wherein the second stationary contact element extends to a region outside the opening of the spacer.

5. The switch unit of claim 1, wherein the movable contact element is mounted on the wiring board such that an outer edge of the movable contact element contacts the second stationary contact element, and wherein, upon being pressed in the direction in which the pressure receiving portion approaches the wiring board, the pressure receiving portion causes the movable contact element to contact the first stationary contact element.

6. The switch unit of claim 1, wherein the second stationary contact element is disposed in a region facing the movable contact portion of the movable contact element; and wherein, upon being pressed in the direction in which the pressure receiving portion approaches the wiring board from the state in which the movable contact portion is apart from the second stationary contact element, the movable contact element causes the movable contact portion to contact the second stationary contact element and electrically connects the first stationary contact element with the second stationary contact element.

7. The switch unit of claim 6, wherein the second stationary contact element continuously extends to a region of the wiring board outside a region of the wiring board onto which the movable contact element is projected.

8. The switch unit of claim 1, further comprising a plurality of contact sections each including the first stationary contact element, the second stationary contact element, and the movable contact element.

9. The switch unit of claim 1, wherein a length of the first stationary contact element in the predetermined direction is larger than the width of the movable contact portion in the predetermined direction.

10. The switch unit of claim 9, wherein the first stationary contact element extends linearly in the predetermined direction by the length of the first stationary contact element in the predetermined direction.

11. The switch unit of claim 9, wherein the length of the second stationary contact element in the predetermined direction is larger than the length of the first stationary contact element in the predetermined direction.

12. The switch unit of claim 11, wherein the second stationary contact element extends linearly in the predetermined direction by the length of the second stationary contact element in the predetermined direction.

13. The switch unit of claim 1, wherein heights of both ends of the movable contact portion opposite to each other in the predetermined direction with respect to the wiring board are larger than heights of both ends of the movable contact portion opposite to each other in a direction perpendicular to the predetermined direction with respect to the wiring board.

14. The switch unit of claim 1, wherein the second stationary contact element extends linearly in the predetermined direction by the length of the second stationary contact element in the predetermined direction.

* * * * *